United States Patent [19]

Sparrow

[11] Patent Number: 4,682,458

[45] Date of Patent: Jul. 28, 1987

[54] DRY LAID FLOORS

[75] Inventor: Ian H. Sparrow, Bottesford, England

[73] Assignee: Trent Jetfloor Limited, Hoveringham, England

[21] Appl. No.: 824,296

[22] Filed: Jan. 29, 1986

Related U.S. Application Data

[63] Continuation of Ser. No. 546,363, Oct. 27, 1983, abandoned.

[51] Int. Cl.[4] ..... E04C 1/00

[52] U.S. Cl. ..... 52/309.8; 52/320; 52/321; 52/322; 52/323; 52/404; 52/483

[58] Field of Search ..... 52/309.8, 483, 320, 52/321, 322, 323, 404

[56] References Cited

U.S. PATENT DOCUMENTS 1,990,001 2/1935 Rutten ..... 52/322
3,290,843 12/1966 Werman ..... 52/323

FOREIGN PATENT DOCUMENTS 1057651 3/1954 France .
2202211 5/1974 France .
2053313 2/1981 United Kingdom .

OTHER PUBLICATIONS

*Building,* 23 Jan. 1981, pp. 55 & 56, "Clog Warming".
Jetfloor Super (leaflet with two sides), Trent Concrete Floors, Ltd., Hoveringham, Nottingham NG14 7JX, England.

*Primary Examiner*—Thurman K. Page
*Attorney, Agent, or Firm*—Thomas & Kennedy

[57] ABSTRACT

The floor is composed of parallel spaced beams (11) having flanges (12) and blocks (13) of polystyrene foam which are laid on the flanges to bridge the gaps between the beams. Boards (26) are laid on the polystyrene blocks, and are supported by the blocks, which form load-bearing members of the floor. The blocks may have flanged portions (14) extending over the beams, so as to provide heat insulation.

8 Claims, 8 Drawing Figures

DRY LAID FLOORS

This is a continuation of application Ser. No. 546,363 filed on Oct. 27, 1983 now abandoned.

TECHNICAL FIELD

This invention relates to a dry-laid floor, i.e. a floor of the type in which wet concrete or the like is not used for the basic supporting structure, but components are laid in a preformed state.

BACKGROUND OF THE INVENTION

Dry-laid floors have been known for centuries and it is still common practice to lay wooden boards across joists to form such a floor.

Where a heavy load-bearing floor has been required, e.g. in factories, it has been common, however, to lay solid floors using wet concrete.

In more recent years, suspended floors have been laid on concrete or steel beams. A reinforced concrete raft is often cast in situ on such beams by means of shuttering laid between the beams. An example of a floor of this type is illustrated in U.K. Patent Specification No. 2053313. Parallel beams of inverted-T shape are provided and panels are laid between the beams, supported on the flanges defined by the cross-piece of the "T". Wet concrete is then laid on the panels and on the beams and allowed to set. The ends of the panels adjacent the beams are bevelled to form a triangular section gap between each end of each panel and the adjacent upright wall of the corresponding beam. This gap fills with concrete to form concrete columns along the beams to support the concrete raft.

In this prior art patent specification, the panels, which form shuttering, are left in situ and are made of material with good heat insulating properties, foamed polystyrene being preferred. The foamed polystyrene supports the unset concrete during construction of the floor, but has no supporting function in the completed floor. The set concrete shrinks away from the panels and the raft is wholly supported by the beams.

The contribution to the art provided by the published U.K. patent specification is an improvement in insulation effected by providing foamed polystyrene insulating members around the underside of the beams.

It is also common practice to provide dry-laid floors supported by beams. Slabs of concrete are dry-laid on the beams. Heat insulation in floors of this type has been provided by means of sheets of foamed polystyrene laid on the slabs and beams, with a surface covering of wooden sheets. The wooden sheets spread the load, in use, and avoid local damage to the polystyrene layer. The polystyrene layer is thin and has no supporting function.

SUMMARY OF THE INVENTION

Foamed polystyrene is extensively used for insulating purposes in both dry-laid and wet-laid floors. It is always used purely for insulating purposes in the finished floor. The present inventor has now made the surprising discovery that it is possible to use foamed polystyrene members for load-supporting purposes in a floor. This enables a dry-laid floor to be constructed without use of concrete slabs. The floor is, therefore, much lighter than conventional floors, much easier to lay and much cheaper and the supporting members also provide inherent excellent heat insulation properties.

The present invention provides a dry-laid floor comprising parallel, spaced beams a multiplicity of foamed plastics members laid on the beams and an upper layer over the members, wherein the foamed plastics members are blocks, which support the upper layer and serve as load bearing members of the floor. The foamed plastics blocks are preferably polystyrene blocks and the upper layer may comprise wooden boards.

The blocks may be laid on the top surfaces of the beams, or the beams may have flanges below the top surfaces for supporting the blocks. In the latter case, the blocks also preferably have flanges which extend over the tops of the beams to form a continuous planar upper surface.

The distance between block support surfaces of adjacent beams is, preferably, not more than 900 mm and, advantageously not more than 600 mm. The depth of each block above the support surface is, preferably, not less than 80 mm and advantageously, not less than 100 mm.

The invention also resides in a method of constructing a dry-laid floor having parallel spaced beams, the method comprising laying foamed plastics blocks on the beams to bridge the gaps between the beams so as to form load-bearing members. The blocks are preferably polystyrene blocks and may have wooden panels adhered to their upper surfaces, or otherwise, wooden panels are laid on the blocks.

BRIEF DESCRIPTION OF THE DRAWING

Reference is now made to the accompanying drawings, wherein.

DETAILED DESCRIPTION

Figure 1:
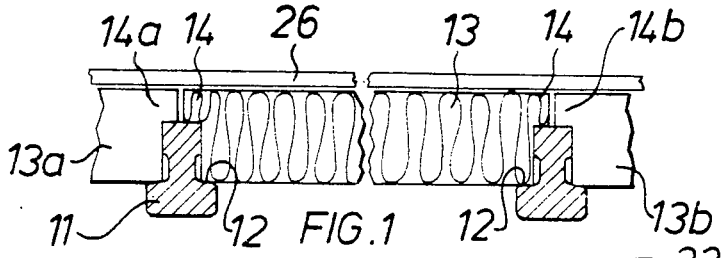
FIG. 1 is a diagrammatic sectional view of part of a dry-laid floor according to the invention.
Figure 7:
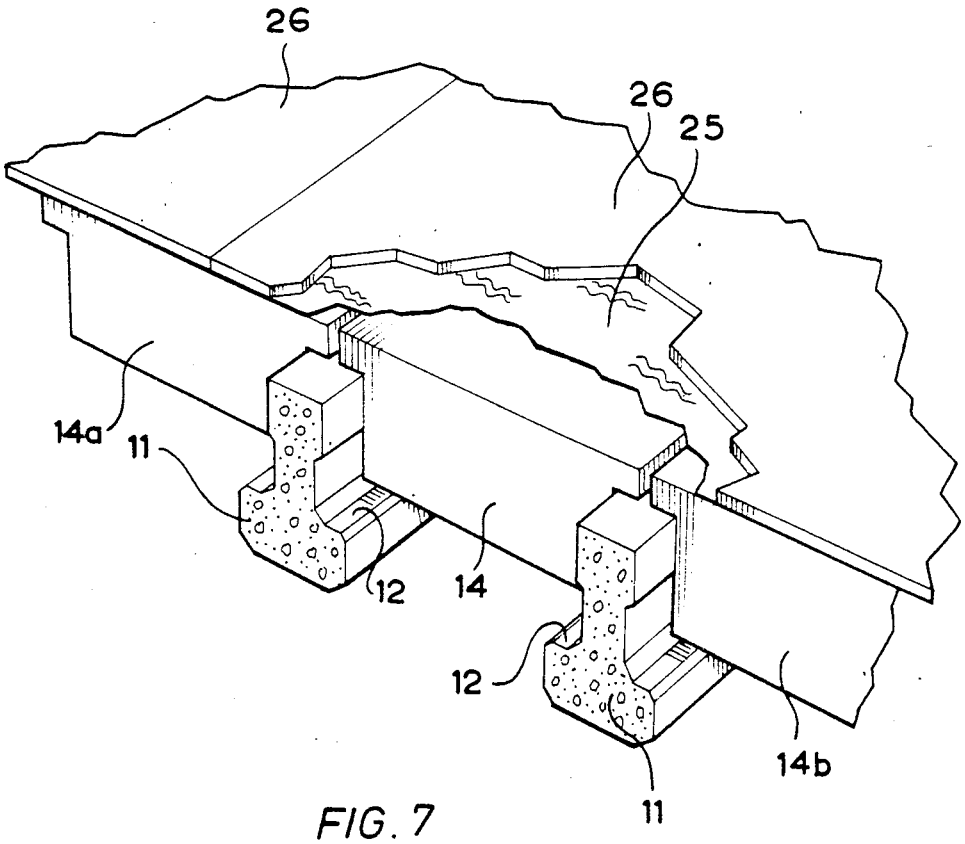
FIG. 7 is a perspective view, partly in section, of a part of a dry-laid floor according to the embodiment of FIG. 1.

Referring to FIGS. 1 & 7, the floor is shown to comprise parallel, spaced beams 11, only two being shown. The particular beams shown are made of reinforced concrete and are basicallly of inverted T shape, with the bars of the T defining flanges 12. Closed-cell foamed plastics blocks 13 are laid in alignment between the beams on the flanges 12, so as to bridge the gap between the beams. Each block 13 is a close fit between the beams. The blocks have no reinforcing elements or reinforcing fillers.

Each block has opposite edge flange portions 14 which extend over part of the top of each beam 11. On the opposite side of each beam, other blocks 13*a*, 13*b* have flange portions 14*a*, 14*b*, which butt against the flange portion 14 to define a continuous planar upper surface. Panels of wood 26 are laid on the blocks, with a thin plastics sheet 25 between the wood and the blocks (not shown in FIG. 1) to serve as a vapour check.

In this particular example, the distance between the flanges 12 is about 800 mm and the total width of each block, including the flange portions 14, about 900 mm. The depth of each block is about 140 mm, with about 40 mm above the top level of the beams.

Figure 2:
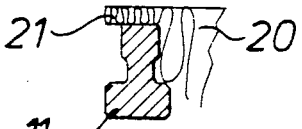
FIG. 2 shows how an edge of the floor may be finished.

At the edges of the floor, special edge blocks 20 of foamed plastics may be used (FIG. 2). In these blocks, the flange portion 21, on one side, is extended to cover the whole of the end beam 11.

Figure 3:
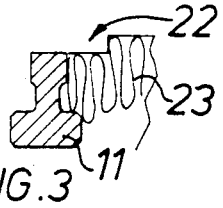
FIG. 3 shows a modification of the finishing of the edge of the floor.

An alternative arrangement is shown in FIG. 3, where the flange portion is omitted at one side and the block 23 has a rebate 22 instead. The rebate, which effectively extends over the beam 11, may be filled with a foamed plastics panel (not shown).

Figure 4:
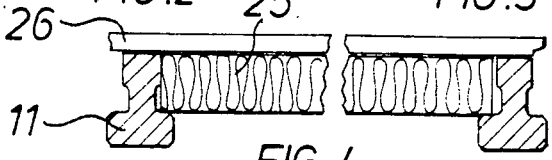
FIGS. 4 to 6 show modifications of the floor illustrated in FIG. 1.

FIG. 4 illustrates a floor arrangement in which flange portions are omitted entirely and the blocks 25 extend only to the tops of the beams 11. Foamed plastics sheets and wooden panels 26 are laid across the top surface defined by the beams and the blocks.

Figure 5:
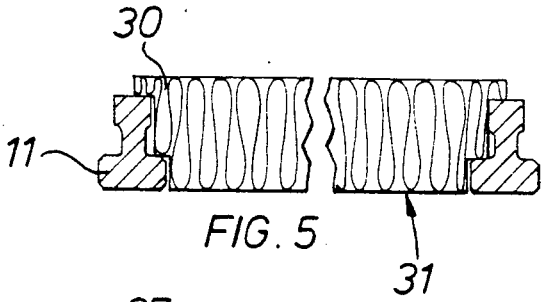

FIG. 5 shows an alternative, similar to the arrangement of FIG. 1, but in which the block 30 extends to the bottoms of the beams 11. This defines a flat lower face 31, together with the bottoms of the beams, which may be finished to define a ceiling.

Figure 6:
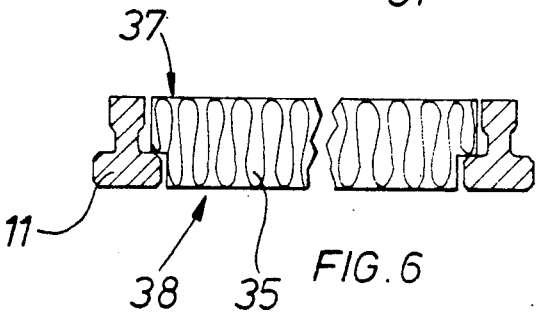

FIG. 6 shows a similar modification of the arrangement shown in FIG. 4, the blocks 35 with the beams 11 defining flat top and bottom surfaces, 37, 38 respectively.

The blocks need not terminate flush with, or above the bottom surfaces of the beams, but may extend below the beams.

It is also envisaged that instead of the blocks being covered with wood, a concrete or other screed may be laid on the blocks.

The blocks of expanded foamed plastics are preferably composed of polystyrene, but other foamed plastics may be used, e.g. polyurethane.

Figure 8:
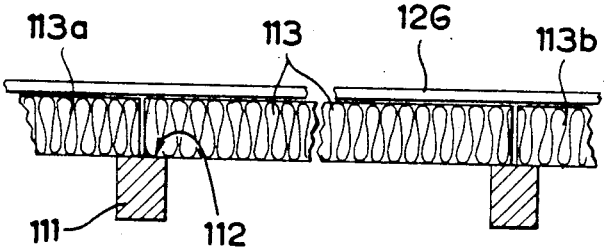
FIG. 8 is a diagrammatic sectional view of part of another embodiment of a dry-laid floor according to the invention.

The beams need not be flanged and may, for example consist of wood or steel, although prestressed or reinforced concrete is preferred. FIG. 8 shows an alternative embodiment comprising beams 111 without flanges and having top surfaces 112. The blocks 113, **113*a*, and 113*b*, are laid on the top surfaces with their end faces substantially in contact to define a thick continuous foamed plastics layer over the beams. An upper layer 126** is laid on the blocks.

I claim:

1. A dry-laid floor comprising a plurality of elongated support beams arranged in parallel, spaced apart relationship in a horizontal plane, the distance between adjacent beams being not more than about 900 mm, prefabricated blocks of foamed polystyrene resting on said beams and bridging the gaps between adjacent ones of said beams, the thickness of each said block of foamed polystyrene extending above said beams being not less than about 100 mm so as to form a substantially rigid load bearing surface that spans the spaces between said beams, said blocks of foamed polystyrene forming a substantially flat continuous upper surface suitable for supporting hard flooring surface, and a hard flooring surface resting on and supported by said blocks of foamed polystyrene.

2. A dry-laid floor according to claim 1, wherein the blocks are composed of foamed polystyrene.

3. A dry-laid floor according to claim 1, wherein the beams have side flanges below their top surfaces, the blocks being supported on the side flanges, and each block has an upper flange portion which extends over the top surface of a beam on which it is supported, the upper flange portions extending over the top surfaces of the beams to form a substantially continuous planar upper surface of the blocks in the floor.

4. A dry-laid floor comprising a plurality of parallel spaced beams having planar top surfaces, blocks of foamed plastic positioned over the beams and seated on said top surfaces of adjacent ones of said beams so as to bridge the gaps between the beams, edges of adjacent blocks being juxtaposed so that the upper surfaces of the blocks form a substantially continuous planar upper surface over the beams, the thickness of each block being not less than 100 mm, the blocks being unsupported in the gaps between the beams, and an upper layer of flooring material laid on said blocks, whereby the blocks define load bearing members of the floor so that a load on the flooring material is transferred to the beams through said blocks without any additional support means between the flooring material and the beams.

5. A dry-laid floor according to claim 4, wherein the distance between adjacent beams is not less than 900 mm.

6. A dry-laid floor according to claim 4, wherein the distance between adjacent beams is not more than 600 mm.

7. A dry-laid floor comprising a plurality of parallel spaced T-beams, said beams being inverted T-shaped in cross section with the cross bar of the T forming side projecting flanges and the stem of the T forming an upwardly extending web with a top surface, blocks of foamed polystyrene, said blocks being approximately T-shaped in cross section with the stem of the T resting on the flanges of said beams and bridging the gaps between the beams, the cross bar of the T of said blocks overlying the top surface of the upwardly extending webs of adjacent ones of the T-beams and the end portions of the cross bars of adjacent blocks being juxtaposed so that the upper surfaces of said blocks form a substantially continuous planar upper surface over the T-beams, the distance between adjacent flanges of each two adjacent beams being not more than 900 mm, the thickness of each block being not less than 100 mm, and an upper layer of wooden boards laid on the blocks, whereby the blocks define load-bearing members of the floor and support the boards on the beams.

8. A dry-laid floor comprising a plurality of parallel T-beams, said T-beams being of inverted T-shape in cross section with the cross bar of the T forming side projecting flanges and the stem of the T forming web extending upwardly from the flanges and having a top surface, blocks of foamed plastic positioned over the flanges of said T-beams and bridging the gaps between the stems of adjacent ones of T-beams with each block shaped at its upper edge portions with upper laterally extending flanges which project above the top surfaces of the stems of the T-beams and which are formed as an integral part of each block, each upper flange portion defining a laterally extending end edge which lies adjacent a laterally extending end edge of another block laid on the other side of a mutual beam so that the upper flange portions substantially cover the beams and the blocks define a substantially continuous planar upper surface, and an upper layer of flooring material laid on said blocks, whereby the blocks define load bearing members of the floor and support the flooring material on the beams.

* * * * *